US008696041B1

(12) United States Patent
Kemp

(10) Patent No.: US 8,696,041 B1
(45) Date of Patent: Apr. 15, 2014

(54) SELF-ALIGNING GRIPPING ASSEMBLY

(71) Applicant: Norman H. Kemp, Tarrant County, TX (US)

(72) Inventor: Norman H. Kemp, Tarrant County, TX (US)

( * ) Notice: Subject to any disclaimer, the term of this patent is extended or adjusted under 35 U.S.C. 154(b) by 0 days.

(21) Appl. No.: 13/694,802

(22) Filed: Jan. 9, 2013

(51) Int. Cl.
*E21B 19/10* (2006.01)

(52) U.S. Cl.
USPC ..... 294/102.2

(58) Field of Classification Search
USPC ..... 294/102.1, 102.2, 86.28, 86.3, 902
See application file for complete search history.

(56) References Cited

U.S. PATENT DOCUMENTS 1,436,246 A * 11/1922 Greve ..... 175/423
1,598,709 A * 9/1926 Butler ..... 294/102.2
1,650,101 A * 11/1927 Taylor ..... 188/67
1,906,895 A * 5/1933 Armstrong ..... 294/86.17
2,017,451 A * 10/1935 Wickersham ..... 285/37
2,026,295 A * 12/1935 Baker ..... 294/86.13
2,109,493 A * 3/1938 Lundeen ..... 188/67
2,263,364 A * 11/1941 Nichols ..... 294/102.2

* cited by examiner

*Primary Examiner* — Dean Kramer
(74) *Attorney, Agent, or Firm* — Jack A. Kanz

(57) ABSTRACT

A plurality of radially arcuate slip segments supported in a bowl are interlocked together by tongues which extend radially from the axially extending sides of the segments and mate with slots in the axially extending sides of adjacent segments to prevent axial displacement of the slip segments with respect to each other.

9 Claims, 6 Drawing Sheets

SELF-ALIGNING GRIPPING ASSEMBLY

This invention relates to gripping devices for holding cylindrical bodies such as a pipe, other tubular goods and/or other elongated cylindrical structures. More particularly, it relates to assemblies including gripping jaws or slips which remain axially stabilized and aligned with respect to each other as they are radially expanded or compressed to hold such cylindrical bodies.

Conventional pipe gripping devices (commonly referred to as "slips") usually employ a plurality of axially elongated radially arcuate jaw segments carried in a supporting bowl which defines an axially extending central opening with inwardly inclined inner surfaces. The jaw segments (sometimes referred to herein as elements or slips) form a hollow, circumferentially segmented, open-ended cylinder with gripping teeth on the inner surface. The external surfaces of the jaw segments are tapered axially to mate with the inner surface of the bowl so that axial movement of the bowl with respect to the jaws moves the jaw segments radially inwardly, causing the inner surfaces of the jaw segments to converge into contact with and grippingly engage a cylindrical body extending axially through the assembly. Such gripping assemblies are commonly used to support drill pipe and the like during coupling and uncoupling; to secure end caps to open pipe ends; and in various other situations where cylindrical bodies must be temporarily held and positioned for similar purposes.

The arcuate jaw segment assembly must expand radially to allow insertion of a cylindrical body therethrough and must provide sufficient separation between the segments to allow radial compression for engaging the cylindrical body. Since the jaw segments are ordinarily individual elements loosely fitted within the bowl or loosely attached to each other to define a set of jaws, the individual jaw segments often become axially displaced with respect to each other. In such instances, uneven and inconsistent pressures may be applied to individual segments, resulting in poor and unreliable gripping of the cylindrical body and/or damage to the external surface of the cylindrical body being held. Such uneven gripping becomes extremely dangerous when the gripping assembly is used to cap an open pipe end during pressure testing and highly undesirable when the gripping assembly is used to hold precision-sized tubular goods or the like or other precision finished goods. Accordingly, means for stabilizing the arcuate jaw segments to prevent axial misalignment has long been sought but never previously achieved.

In accordance with the present invention each of the individual arcuate segments of a set of slips is provided with a tongue which extends from one axial edge and mates with a cooperating slot in the adjacent axial edge of an adjacent segment. The individual segments are thus loosely joined to form a radially expandable and partially collapsible cylinder. Each tongue may have an expanded head supported on a laterally-extending shank. The circumferentially-extending edges of the shanks are closely fitted within the corresponding circumferentially-extending edges of the slots so that axial movement of the jaw segments with respect to each other is prevented. However, the axially-extending edges of the heads are slightly spaced from the corresponding axially-extending edges of the slots so that the individual arcuate segments may move radially with respect to each other. Accordingly, the jaw cylinder can be expanded or compressed within the limits of the spaces between the axially-extending edges of the tongues and slots while relative axial movement of the individual jaw segments with respect to each other is prevented.

In order to maintain the jaw assembly in the expanded condition (to permit insertion of cylindrical bodies without contacting the inner surfaces of the jaws during insertion) a continuous circumferential groove is formed in the inner surface of the jaw assembly and an expansion spring inserted in the groove. The spring thus expands the jaw assembly to the maximum permitted by the tongue and slot structures. The spring thus insures that the jaw assembly is fully expanded until compressed by axial movement of the jaw segment assembly with respect to the bowl. The assembly of the invention thus prevents axial misalignment of the individual jaw segments, assuring that the cylindrical body is uniformly gripped when the jaws are closed and uniformly released when the jaws are opened. Other features and advantages of the invention will become more readily understood from the following detailed description taken in connection with the appended claims and attached drawing in which:

Figure 1:
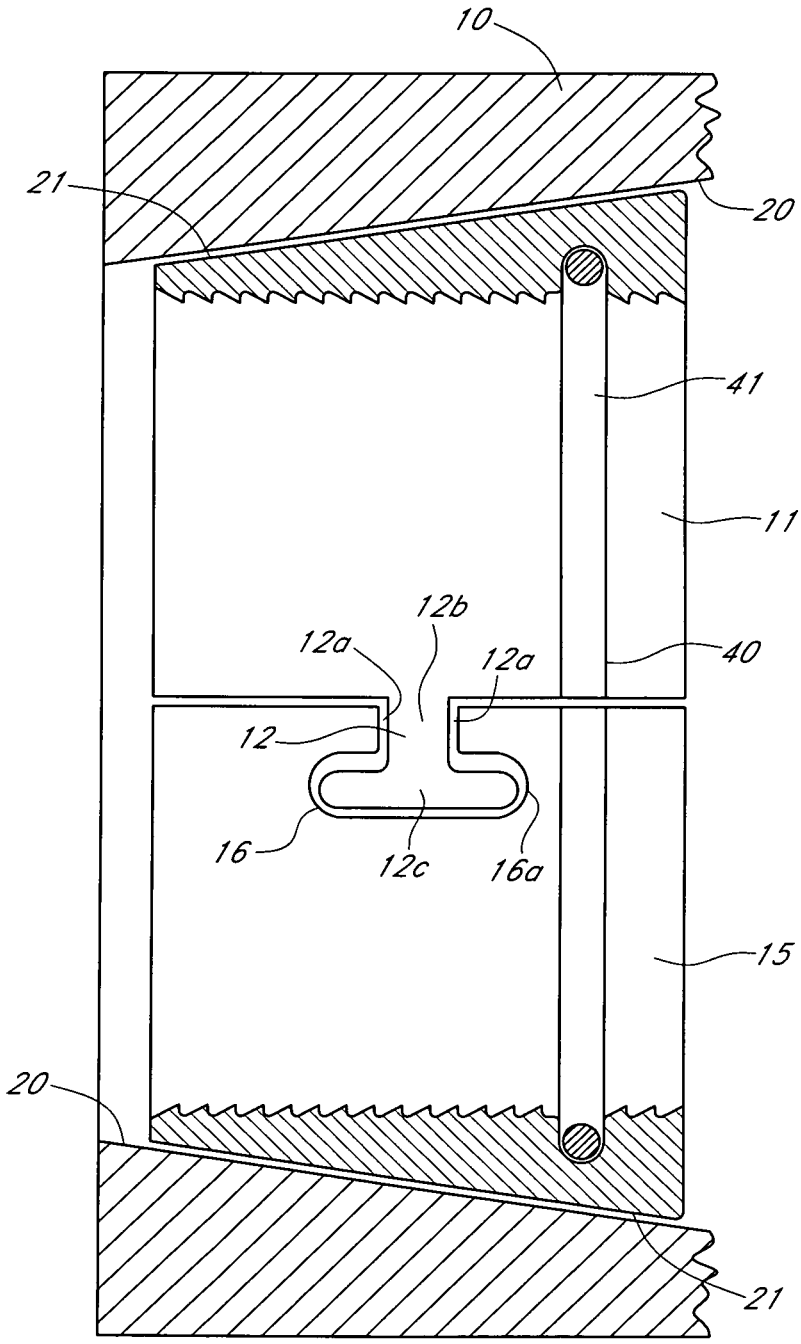
FIG. 1 is a sectional view of a segmented jaw and bowl assembly of the invention illustrating the expansion ring and the interlocking tongue and slot arrangement.

The above-described drawing is incorporated into and forms part of the specification to illustrate exemplary embodiments of the invention. Throughout the drawing like reference numerals designate corresponding elements. The figures are not to scale but are intended to disclose the inventive concepts by illustration. This drawing, together with the description herein, serves to explain the principles of the invention and is only for the purpose of illustrating preferred and alternative examples of how the invention can be made and used.

It will be recognized that the principles of the invention may be utilized and embodied in many and varied forms, and that various materials, component parts and arrangements of components may be employed in utilizing the invention. In order to demonstrate these principles, the invention is described herein by reference to specific preferred embodiments. The invention, however, is not limited to the specific forms illustrated and described in detail.

In conventional pipe gripping assemblies, a plurality of arcuate jaw segments are supported in a bowl which defines an axially extending central opening with inwardly inclined inner surfaces. The external surfaces of the jaw segments are tapered axially to mate with the inner surface of the bowl so that axial movement of the bowl with respect to the jaw segments moves the jaw segments radially inwardly to converge into contact with a pipe or other cylindrical body extending axially through the assembly. If the jaw segments are not precisely interconnected or otherwise restrained, individual jaw segments may move axially with respect to each other, resulting misalignment of the segments and application of uneven or otherwise inappropriate pressures to the surface of the pipe by the individual jaw segments.

In accordance with the present invention, individual jaw segments are interconnected in a manner to prevent axial movement of the individual segments with respect to each other while permitting the segments to move radially to uniformly contact the surface of the pipe.

As illustrated in FIG. 1 a plurality of jaw segments 11, 15 is supported in a bowl 10. The bowl 10 defines an open-ended cylinder with an inwardly inclined internal surface 20. Jaw segments 11, 15 are supported within bowl 10 and arranged to define an open-ended cylinder with an inclined outer surface 21 which mates with the inclined inner surface 20 of bowl 10 so that axial movement of bowl 10 with respect to jaw segments 11, 15 causes the jaw segments 11, 15 to converge radially and contact the external surface of a cylindrical body (not illustrated) such as a pipe extending through the assembly. In order to prevent axial misalignment of individual jaw segments with respect to each other, each jaw segment is attached to each adjacent segment with cooperating tongues and slots.

As illustrated in FIG. 1, jaw segment 11 has a substantially T-shaped tongue 12 extending from one lateral (axially extending) edge thereof which nests in and cooperates with a mating T-shaped slot 16 in the adjacent lateral edge of jaw segment 15. To prevent axial displacement of segment 11 with respect to segment 15, the circumferentially extending edges 12*a* of the shank 12*b* of the T-shaped tongue 12 (as well as the edges of the head 12*c* of T-shaped tongue 12) fit snugly in the corresponding edges of T-shaped slot 16. However, the head portion 16*a* of slot 16 is circumferentially expanded to permit the jaw segments 11, 15 to move radially with respect to each other and thus converge on the external surface of a pipe (or other cylindrical body) extending axially through the assembly.

It should be understood that while FIG. 1 illustrates a single segment 11 with a tongue 12 mating with a single jaw segment 15 with a T-shaped slot 16, in the preferred embodiment each jaw segment 11, 15 may have one or more T-shaped tongues on one edge and one or more T-shaped slots on its opposite edge to cooperate with similar slots and tongues on adjacent segments as described above to prevent (or at least substantially minimize) axial misalignment of such jaw segments with respect to each other.

It should also be understood that while FIG. 1 illustrates an assembly which includes only jaw segments 11 and 15, gripping assemblies employing the principles of the invention may include any desired number of jaw segments to accomplish the gripping function required in any particular application.

Where multiple jaw segments are arranged to form a gripping assembly as described above, the lateral (axially extending) edges of the arcuate jaw segments must be spaced apart sufficiently to permit the inner jaw surfaces to uniformly contact the surface of a cylindrical body (such as a pipe) extending through the assembly when the gripping assembly is closed. However, the assembly must be expandable radially when opened to allow pipe or the like to be inserted therein without permitting the jaw segments to contact (and possibly mar or scratch) the pipe surface during insertion.

To automatically move the jaw segments outwardly and aid in maintaining axial alignment thereof, a circumferential groove 40 is formed in the inner surface of the assembly of jaw segments 11, 15. As illustrated in FIG. 1, an expansion spring 41 in the form of a ring is positioned within groove 40. The depth of groove 40 is sufficient to contain the full diameter of the ring formed by spring 41 and spring 41 is formed with a space between the ends thereof to allow the spring 41 to expand and contract as required. In its relaxed condition, the diameter of spring 41 is greater than the maximum internal diameter of the jaw segment assembly to insure that the spring 41 maintains the jaw assembly at its maximum internal diameter (maximum open condition) until the jaw segment assembly is compressed by axial movement thereof with respect to bowl 10. The compression strength of spring 41, however, should be sufficiently low to permit radial compression of the jaw segment assembly without interference during normal operation of the jaw assembly. Nonetheless, the spring 41 insures uniform opening of the jaw assembly when radial compression force on the jaw segment assembly is relaxed.

Figure 1A:
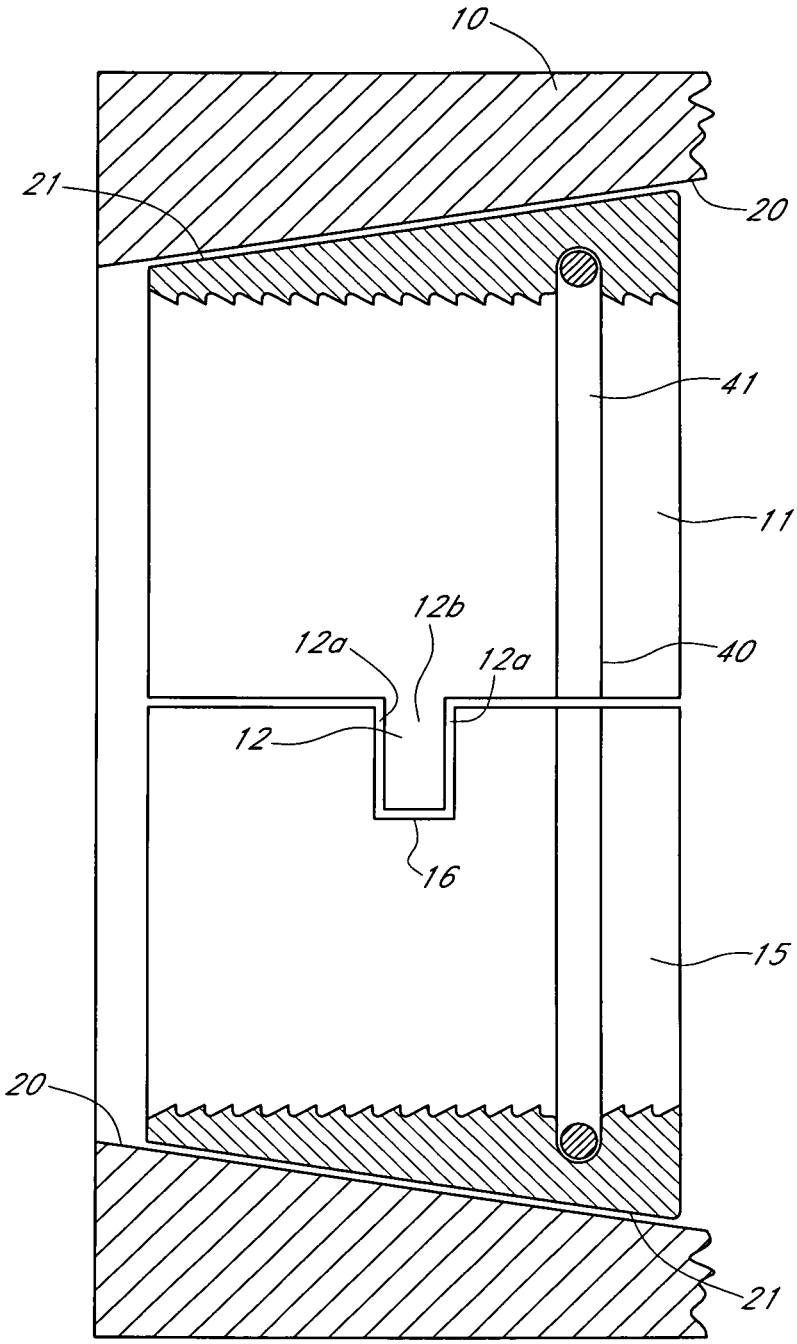
FIG. 1A is a sectional view of a segmented jaw and bowl assembly of the invention illustrating an alternative arrangement of the tongue and slot.

It will be recognized that although the tongues 12 and slots 16 are described as "T-shaped," such tongues and slots need not be in the configuration of a conventional T. For example, the edges of the head and shank of the tongues (as well as the corresponding edges of the slot) only need be configured to prevent axial movement of the jaw segments with respect to each other while permitting the jaw segment assembly to expand or contract radially. Any configuration of the tongues and slots which accomplish this function is considered "T-shaped" as that term is used herein. For example, the circumferentially extending edges 12 may be parallel and mate with corresponding parallel circumferentially extending edges of the slot 16 as shown in FIG. 1A. In this configuration radial expansion of the jaw assembly is not necessarily limited by the tongue and slot arrangement, but the tongue and slot arrangement prevents axial displacement of the jaw segments with respect to each other.

Figure 2A:
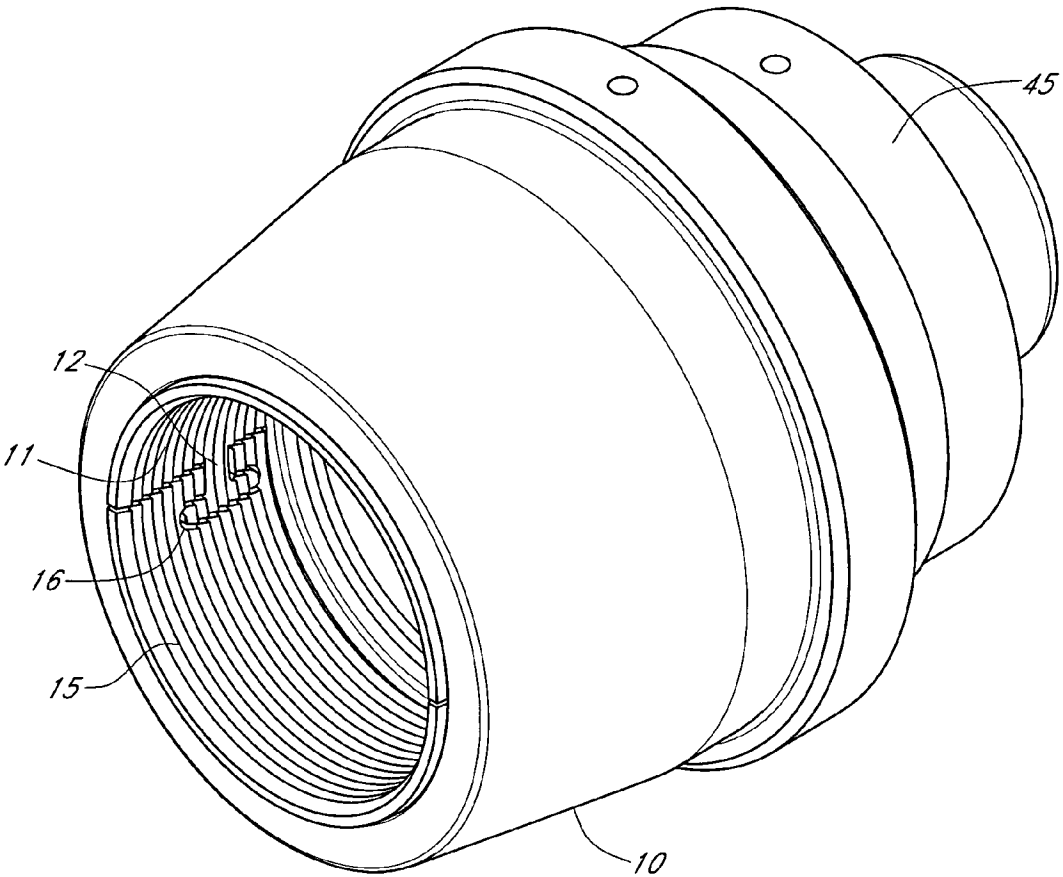
FIG. 2A is a perspective view of an end cap assembly employing the gripping assembly of the invention.
Figure 2B:
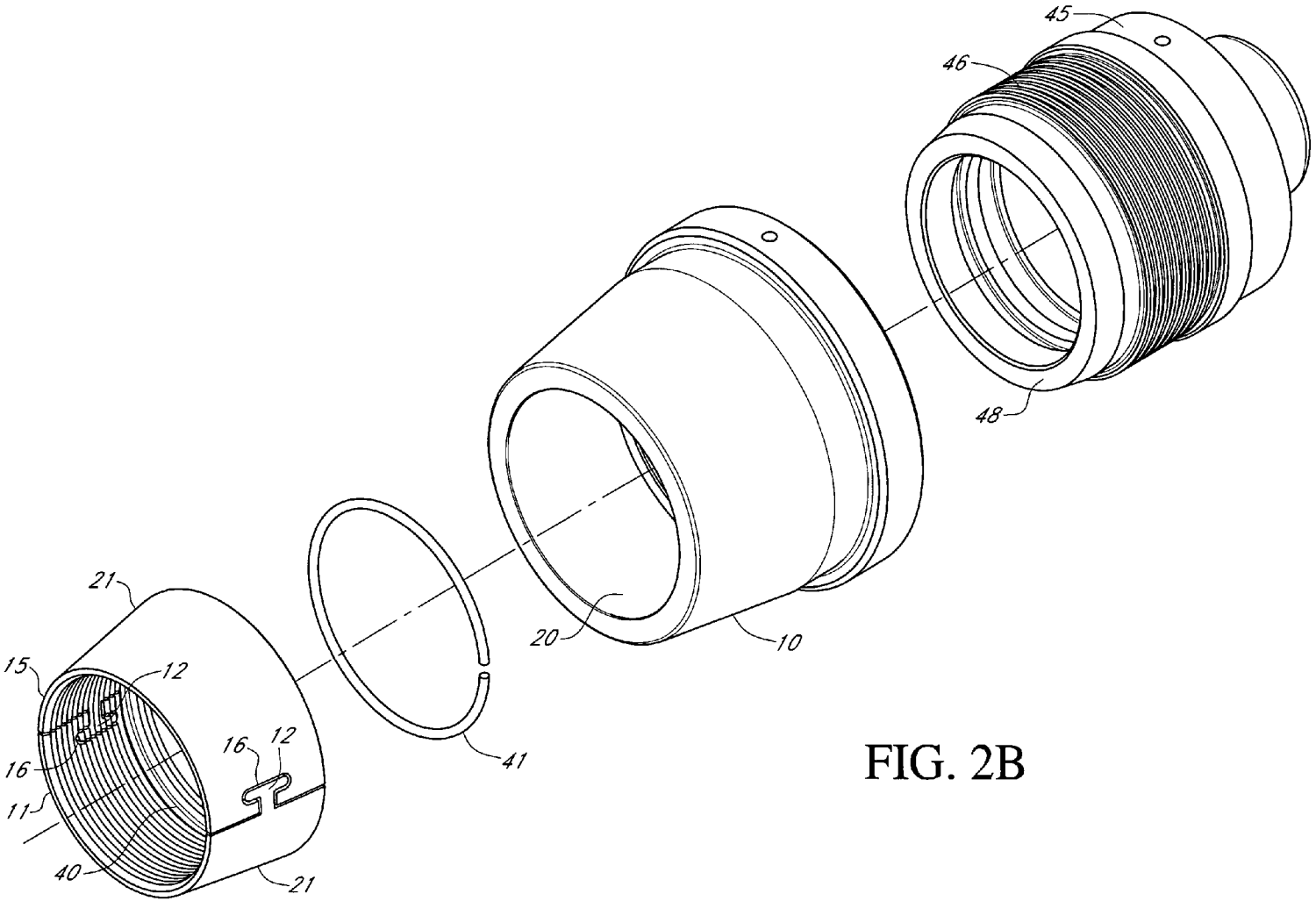
FIG. 2B is an exploded view of the assembly of FIG. 2A.
Figure 3:
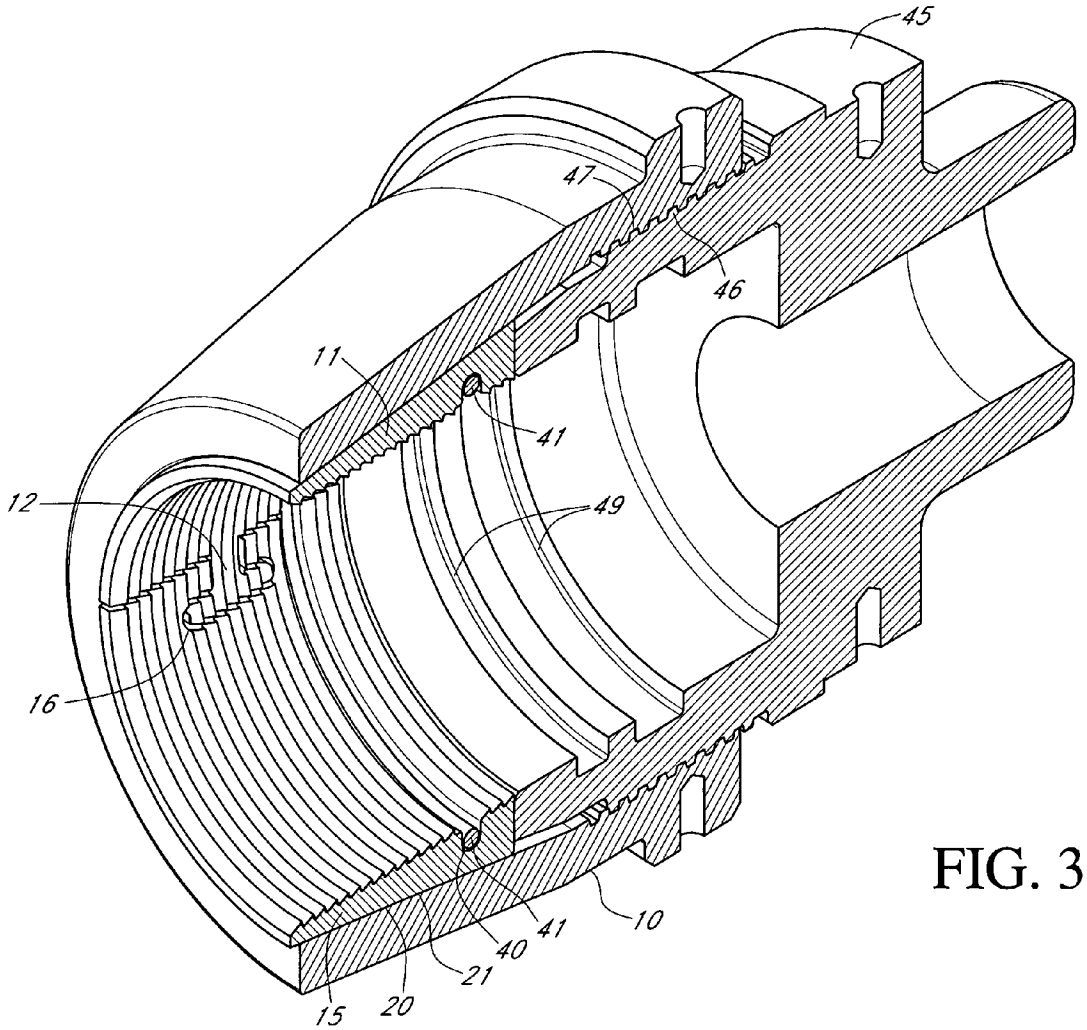
FIG. 3 is a sectional view of the assembly of FIGS. 2A and 2B.

FIGS. 2A, 2B and 3 illustrate an end cap enclosure (applicable for pressure testing of pipe assemblies) which embodies the principles of the invention. The end cap enclosure comprises a bowl 10 with an inwardly inclined inner surface 20 and a plurality of jaw segments 11, 15 fitted within the bowl 10 to form a set of gripping jaws. The outer surfaces 21 of the jaw segments 11, 15 are inclined to mate with the inclined inner surface 20 of bowl 10 so that the jaw segment assembly is radially compressed when the bowl 10 is moved axially with respect to the jaw segments. As described above, T-shaped tongues 12 are nested in T-shaped slots 16 to permit radial compression and expansion of the jaw segment assembly but prevent axial misalignment of the jaw segments with respect to each other. An expansion spring 41 is nested in circumferential groove 40 to maintain the gripping assembly in the maximum open condition when no compression forces are applied to the jaw segment assembly.

In the assembly illustrated in FIGS. 2A, 2B and 3, the inner surface of the bowl 10 (at the end thereof opposite the inclined inner surface 20) is threaded to receive end cap 45. End cap 45 carries external threads 46 which mate with internal threads 47 in bowl 10. When end cap 45 is screwed into bowl 10, the end 48 thereof engages the jaw segment assembly to urge the jaw segment assembly toward the opposite open end of bowl 10. Since the internal surface 20 of bowl 10 is inclined inwardly in the direction toward the open end thereof, the jaw segment assembly is radially compressed to uniformly engage the outer surface of a pipe (not shown) extending therethrough. Grooves 49 in the internal surface of end cap 45 carry O-rings (not shown) or similar gaskets to seal the inner surface of the end cap to the outer surface of the pipe (not shown).

Figure 4:
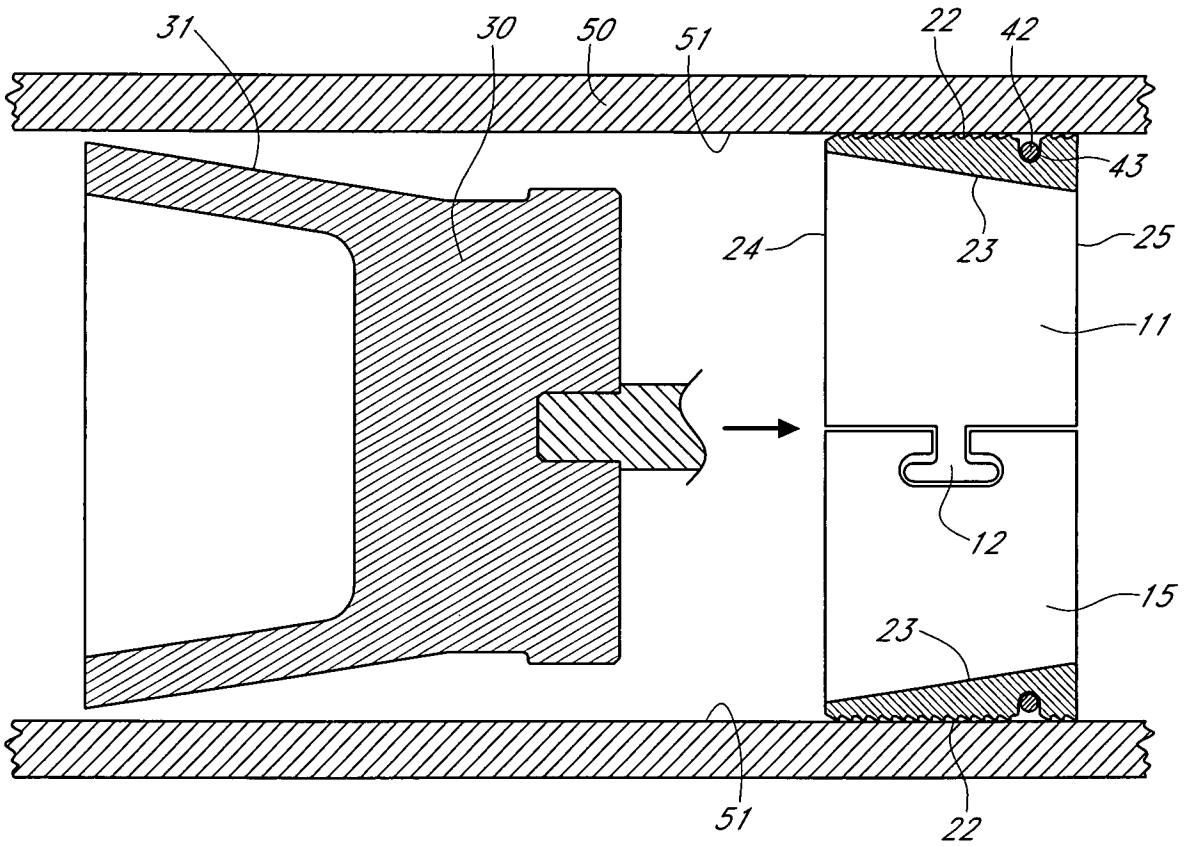
FIG. 4 is a sectional view of an assembly employing the principles of the invention in an arrangement for gripping the internal surface of a pipe.

As illustrated in FIG. 4, the principles of the invention may also be employed in devices for gripping the internal surface of pipe and/or for devices for re-sizing or re-shaping deformed pipe. For operating on the internal surface 51 of pipe 50 the jaw segments 11, 15 are shaped to define a uniformly cylindrical outer surface 22 which may have teeth for gripping the pipe or may be smooth for re-shaping pipe. Alternatively, where re-shaping of the internal diameter of the pipe is required, the external surface of the jaw assembly can be appropriately shaped. The internal surfaces 23 are inclined so that the internal diameter of the jaw segment assembly decreases in the direction extending from the first open end 24 toward the second open end 25.

The jaw segment 11 carries a T-shaped tongue 12 on at least one lateral edge which mates with a T-shaped slot in adjacent jaw segment 15. The T-shaped tongue and T-shaped slot are arranged and sized as described hereinabove to permit radial expansion and contraction of the jaw segment assembly while preventing axial misalignment of the jaw segments with respect to each other.

To maintain the jaw segment assembly in the reduced diameter (contracted or disengaged) condition, a contraction spring 42 is mounted in a circumferential groove 43 in the outer surface of the jaw segment assembly. In its relaxed condition, the ring formed by contraction spring 42 has an internal diameter which is slightly less than the diameter of groove 43 so that the jaw segment assembly is maintained in the contracted condition.

A camming mandrel 30 having a conical external surface 31 is mounted for axial movement within the jaw segment assembly. External surface 31 cooperates with inclined internal surfaces 23 as the camming mandrel 30 is drawn into the jaw segment assembly to radially expand the jaw segment assembly and urge the outer surfaces of the jaw segments 11, 15 into contact with the inner surface 51 of pipe 50.

Although the invention is described herein with specific reference to slips or jaws for gripping pipe, it will be recognized that the principles are equally applicable to other expandable gripping devices for holding other structures.

It will be appreciated that the invention is not limited to any particular dimensions, materials or arrangement of components. Various materials of construction and conventional components will be found suitable by those skilled in the art, and the arrangement, size and location of the various components may be varied as desired.

While only exemplary embodiments of the invention have been illustrated and described in detail herein, it will be readily recognized that the principles of the invention may be used in various forms to provide self-aligning gripping assemblies for cylindrical and/or tubular goods. It is to be understood, therefore, that even though numerous characteristics and advantages of the invention have been set forth in detail herein, the foregoing description, together with details of the structure and function of the various embodiments, is to be considered illustrative only. Various changes and modifications may be made in detail, especially in matters of shape, size and materials as well as arrangement and combination of parts, without departing from the spirit and scope of the invention as defined by the appended claims.

What is claimed is:

1. An assembly for gripping cylindrical bodies comprising:

a) a cylindrical bowl having first and second axially aligned open ends with an inner surface inclined inwardly in the direction from said first open end toward said second open end;

b) gripping jaws comprising at least two cooperating arcuate segments which define a hollow cylinder having first and second axially aligned open ends, a generally cylindrical inner surface and an outer surface inclined inwardly in the direction from said first open end toward said second open end and cooperating with said inwardly inclined inner surface of said bowl to urge said cooperating segments inwardly when moved axially with respect to said bowl; and c) each of said cooperating segments having a substantially T-shaped tongue extending from one lateral edge thereof which cooperates with a mating substantially T-shaped slot in the lateral edge of an adjacent cooperating arcuate segment to substantially prohibit axial movement of said segments with respect to each other and permit radial movement of said segments with respect to each other only to the extent permitted by movement of said T-shaped tongue in said T-shaped slot.

2. An assembly as defined in claim 1 wherein said inner surfaces of said cooperating arcuate segments have teeth for gripping cylindrical bodies projecting axially through said assembly.

3. An assembly as defined in claim 1 wherein:

a) the inner surfaces of said cooperating arcuate segments define a substantially continuous groove circumscribing the inner surface defined by said cooperating segments; and b) an expansion spring is positioned within said groove urging said cooperating segments radially outwardly with respect to each other to the extent permitted by movement of said T-shaped tongues within said T-shaped slots.

4. An assembly as defined in claim 1 wherein:

a) the inner surface of said first open end of said bowl is threaded to receive an end cap; and b) an end cap enclosure is threadedly received in said first open end.

5. An assembly for gripping cylindrical bodies comprising:

a) a cylindrical bowl having first and second axially aligned open ends with an inner surface inclined inwardly in the direction from said first open end toward said second open end;

b) gripping jaws comprising at least two cooperating arcuate segments which define a hollow cylinder having first and second axially aligned open ends, a generally cylindrical inner surface and an outer surface inclined inwardly in the direction from said first open end toward said second open end and cooperating with said inwardly inclined inner surface of said bowl to urge said cooperating segments inwardly when moved axially with respect to said bowl; and c) each of said cooperating segments having a tongue with a relatively narrow shank and an axially expanded head extending from one lateral edge thereof which cooperates with a mating slot in the lateral edge of an adjacent cooperating arcuate segment, said slot having sides which mate with the shank and head of said tongue to prevent axial movement of said segments with respect to each other and a circumferentially expanded head portion which permits limited circumferential movement of said segments with respect to each other.

6. An assembly as defined in claim 5 wherein said inner surfaces of said cooperating arcuate segments have teeth for gripping cylindrical bodies projecting axially through said assembly.

7. An assembly as defined in claim 5 wherein:

a) the inner surfaces of said cooperating arcuate segments define a substantially continuous groove circumscribing the inner surface defined by said cooperating segments; and b) an expansion spring is positioned within said groove urging said cooperating segments radially outwardly with respect to each other.

8. An assembly for gripping cylindrical bodies comprising:

a) a cylindrical bowl having first and second axially aligned open ends with an inner surface inclined inwardly in the direction from said first open end toward said second open end;

b) gripping jaws comprising at least two cooperating arcuate segments which define a hollow cylinder having first and second axially aligned open ends, a generally cylindrical inner surface and an outer surface inclined inwardly in the direction from said first open end toward said second open end and cooperating with said inwardly inclined inner surface of said bowl to urge said cooperating segments inwardly when moved axially with respect to said bowl;

c) a substantially continuous groove circumscribing the generally cylindrical inner surface defined by said cooperating segments;

d) each of said cooperating segments having a substantially T-shaped tongue extending from one lateral edge thereof which cooperates with a mating substantially T-shaped slot in the lateral edge of an adjacent cooperating arcuate segment to substantially prohibit axial movement of said segments with respect to each other and permit limited radial movement of said segments with respect to each other; and e) an expansion spring is positioned within said groove urging said cooperating segments radially outwardly with respect to each other to the extent permitted by movement of said T-shaped tongues within said T-shaped slots.

9. An assembly for gripping cylindrical bodies comprising:

a) a cylindrical bowl having first and second axially aligned open ends with an inner surface inclined inwardly in the direction from said first open end toward said second open end;

b) gripping jaws comprising at least two cooperating arcuate segments which define a hollow cylinder having first and second axially aligned open ends, a generally cylindrical inner surface and an outer surface inclined inwardly in the direction from said first open end toward said second open end and cooperating with said inwardly inclined inner surface of said bowl to urge said cooperating segments inwardly when moved axially with respect to said bowl;

c) a substantially continuous groove circumscribing the generally cylindrical inner surface defined by said cooperating segments;

d) each of said cooperating segments having a tongue extending from one lateral edge thereof which cooperates with a mating slot in the lateral edge of an adjacent cooperating arcuate segment to substantially prohibit axial movement of said segments with respect to each other and permit radial movement of said segments with respect to each other; and e) an expansion spring is positioned within said groove urging said cooperating segments radially outwardly with respect to each other.

* * * * *